US011918088B2

(12) United States Patent
Paikin

(10) Patent No.: US 11,918,088 B2
(45) Date of Patent: Mar. 5, 2024

(54) GEMSTONE AND METHODS OF CUTTING THE SAME

(71) Applicant: ALBERT GAD LTD., New York, NY (US)

(72) Inventor: Reuven Paikin, Windhoek (NA)

(73) Assignee: Albert Gad Ltd., New York, NY (US)

( * ) Notice: Subject to any disclaimer, the term of this patent is extended or adjusted under 35 U.S.C. 154(b) by 73 days.

(21) Appl. No.: 17/324,670

(22) Filed: May 19, 2021

(65) Prior Publication Data

US 2021/0361040 A1 Nov. 25, 2021

Related U.S. Application Data

(60) Provisional application No. 63/028,387, filed on May 21, 2020.

(51) Int. Cl.
*A44C 17/00* (2006.01)

(52) U.S. Cl.
CPC ..... *A44C 17/001* (2013.01)

(58) Field of Classification Search
CPC ..... A44C 17/001; A44C 17/00
See application file for complete search history.

(56) References Cited

U.S. PATENT DOCUMENTS

| | | | | |
|---|---|---|---|---|
| 693,084 | A | 2/1902 | Townsend | |
| D481,649 | S * | 11/2003 | Samuels | D11/90 |
| 6,761,044 | B2 | 7/2004 | Samuels | |
| 8,156,760 | B2 | 4/2012 | Gad | |
| 2003/0181147 | A1 | 9/2003 | Schachter | |
| 2003/0192346 | A1 | 10/2003 | Samuels | |
| 2005/0000405 | A1 | 1/2005 | Brookshire | |
| 2011/0265514 | A1* | 11/2011 | Fakier | A44C 17/001 63/3 |
| 2012/0060557 | A1 | 3/2012 | Van Looveren | |
| 2016/0120274 | A1* | 5/2016 | Mezhibovsky | A44C 17/001 63/32 |

* cited by examiner

*Primary Examiner* — Jack W Lavinder
(74) *Attorney, Agent, or Firm* — Nixon Peabody LLP

(57) ABSTRACT

A gemstone includes a crown, a pavilion, and a girdle disposed between the crown and the pavilion. The girdle has an octagon-shaped cross-section. The surface of the gemstone is generally divided into a number of groups of interlocking facets disposed at a variety of angles. The groups of facets comprising the surface of the crown generally include star facets, upper intermediate crown facets, lower intermediate crown facets, main crown facets, and upper girdle facets. The upper girdle facets generally abut an upper edge of the girdle. The groups of facets comprising the surface of the pavilion include culet-adjacent facets, candle facets, main pavilion facets, and lower girdle facets. The lower girdle facets generally abut a lower edge of the girdle.

18 Claims, 10 Drawing Sheets

30

GEMSTONE AND METHODS OF CUTTING THE SAME

CROSS-REFERENCE TO RELATED APPLICATIONS

The present application claims the benefit of and priority to U.S. Provisional Patent Application No. 63/028,387, filed May 21, 2020, which is hereby incorporated by reference herein in its entirety.

TECHNICAL FIELD

The present disclosure relates to gemstones, more specifically, the present disclosure relates to a pattern of facets of gemstones.

BACKGROUND

Some gemstones are designed/cut to produce a desirable amount of brilliance, or "sparkle" by forming or cutting a number of individual facets on the exterior surface of the gemstone. Other gemstones are designed/cut to enhance a natural color (e.g., yellow, pink, etc.) of the gemstone. However, it can be difficult to produce a gemstone having a layout of facets at specific angles that produce both a desirable amount of brilliance and also enhance the natural color of the gemstone.

The present disclosure is directed to solving these problems and addressing other needs.

SUMMARY

According to some implementations of the present disclosure, a gemstone comprises a girdle, a crown, and a pavilion. The girdle defines a perimeter of the gemstone and has an octagon-shaped cross-section. The crown forms an upper portion of the gemstone. The pavilion forms the lower portion of the gemstone. A surface of the crown includes a table, a plurality of star facets, a plurality of upper intermediate crown facets, a plurality of lower intermediate crown facets, a plurality of main crown facets, and a plurality of upper girdle facets. The table forms a generally horizontal upper surface of the crown. Each of the plurality of star facets is disposed adjacent to and abutting an edge of the table. Each of the plurality of upper intermediate crown facets is disposed generally between two of the plurality of star facets. An upper vertex of each of the plurality of upper intermediate crown facets abuts a vertex of the table. Each of the plurality of lower intermediate crown facets is disposed between two of the plurality of upper intermediate crown facets. An upper vertex of each of the plurality of lower intermediate crown facets abuts a lower vertex of one of the plurality of star facets. Each of the plurality of main crown facets is disposed between two of the plurality of lower intermediate crown facets. An upper vertex of each of the plurality of main crown facets abuts a lower vertex of one of the plurality of lower intermediate crown facets. The upper girdle facets are formed in pairs of adjacent upper girdle facets. Each pair of adjacent upper girdle facets is disposed generally between two of the plurality of main crown facets. An upper vertex of both upper girdle facets in each pair of upper girdle facets abuts a lower vertex of one of the plurality of lower intermediate crown facets. A surface of the pavilion includes a plurality of culet-adjacent facets, a plurality of main pavilion facets, a plurality of candle facets, and a plurality of lower girdle facets. The plurality of culet-adjacent facets forms a lower point of the pavilion. Each of the plurality of candle facets is disposed between two of the plurality of main pavilion facets. A lower portion of each of the plurality of candle facets is disposed generally between two of the plurality of culet-adjacent facets. Each of the main pavilion facets is disposed between two of the plurality of candle facets. A lower edge of each of the plurality of main pavilion facets abuts an upper edge of one of the plurality of culet-adjacent facets. The lower girdle facets are formed in pairs of adjacent lower girdle facets. Each pair of adjacent lower girdle facets is disposed generally between two of the plurality of main pavilion facets. Each pair of adjacent lower girdle facets has an upper portion of a respective one of the plurality of candle facets disposed generally therebetween. The girdle is positioned between the crown and the pavilion. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a girdle and crown. The girdle forms a perimeter of the gemstone and has an octagon-shaped cross-section. The crown forms an upper portion of the gemstone. A surface of the crown includes a table, a plurality of star facets, a plurality of upper intermediate crown facets, a plurality of lower intermediate crown facets, a plurality of main crown facets, and a plurality of upper girdle facets. The table forms a generally horizontal upper surface of the crown. Each of the plurality of star facets is disposed adjacent to and abutting an edge of the table. Each of the plurality of upper intermediate crown facets is disposed generally between two of the plurality of star facets. An upper vertex of each of the plurality of upper intermediate crown facets abuts a vertex of the table Each of the plurality of lower intermediate crown facets is disposed between two of the plurality of upper intermediate crown facets. An upper vertex of each of the plurality of lower intermediate crown facets abuts a lower vertex of one of the plurality of star facets. Each of the plurality of main crown facets is disposed between two of the plurality of lower intermediate crown facets. An upper vertex of each of the plurality of main crown facets abuts a lower vertex of one of the plurality of lower intermediate crown facets. The upper girdle facets are formed in pairs of adjacent upper girdle facets. Each pair of adjacent upper girdle facets is disposed generally between two of the plurality of main crown facets. An upper vertex of both upper girdle facets in each pair of upper girdle facets abuts a lower vertex of one of the plurality of lower intermediate crown facets.

According to some implementations of the present disclosure, a gemstone comprises a girdle and a pavilion. The girdle forms a perimeter of the gemstone and has an octagon-shaped cross-section. The pavilion forms a lower portion of the gemstone. A surface of the pavilion includes a plurality of culet-adjacent facets, a plurality of main pavilion facets, a plurality of candle facets, and a plurality of lower girdle facets. The plurality of culet-adjacent facets forms a lower point of the pavilion. Each of the plurality of candle facets is disposed between two of the plurality of main pavilion facets. A lower portion of each of the plurality of candle facets is disposed generally between two of the plurality of culet-adjacent facets. Each of the main pavilion facets is disposed between two of the plurality of candle facets. A lower edge of each of the plurality of main pavilion facets abuts an upper edge of one of the plurality of culet-adjacent facets. The lower girdle facets are formed in pairs of adjacent lower girdle facets. Each pair of adjacent lower girdle facets is disposed generally between two of the plurality of main pavilion facets. Each pair of adjacent lower girdle facets has an upper portion of a respective one of the plurality of candle facets disposed generally therebetween.

According to some implementations of the present disclosure, a gemstone comprises a girdle, a crown, and a pavilion. The girdle forms a perimeter of the gemstone and has an octagon-shaped cross-section. The crown forms an upper portion of the gemstone. The pavilion forms a lower portion of the gemstone. A surface of the crown includes a table, a plurality of star facets, a plurality of upper intermediate crown facets, a plurality of lower intermediate crown facets, a plurality of main crown facets, and a plurality of upper girdle facets. The table forms a generally horizontal upper surface of the crown and has a generally octagonal shape. Each of the plurality of star facets is disposed adjacent to the table and is triangle-shaped. Each of the plurality of upper intermediate crown facets is disposed adjacent to the plurality of star facets and is kite-shaped. Each of the plurality of lower intermediate crown facets is disposed adjacent to the plurality of upper intermediate crown facets and is kite-shaped. Each of the plurality of main crown facets is disposed adjacent to the plurality of lower intermediate crown facets, and is kite-shaped. Each of the plurality of upper girdle facets is disposed adjacent to the plurality of main crown facets and is triangle-shaped. A surface of the pavilion includes a plurality of culet-adjacent facets, a plurality of main pavilion facets, a plurality of candle facets, and a plurality of lower girdle facets. The plurality of culet-adjacent facets forms a lower point of the pavilion. Each of the plurality of culet-adjacent facets has a pentagonal shape. Each of the plurality of candle facets is disposed between two of the plurality of main pavilion facets and has six edges. Each of the main pavilion facets is disposed between two of the plurality of candle facets and is pentagon-shaped. The lower girdle facets are formed in pairs of adjacent lower girdle facets. Each pair of adjacent lower girdle facets is disposed generally between two of the plurality of main pavilion facets and has four edges. The girdle is positioned between the crown and the pavilion. Each of the plurality of upper girdle facets is disposed adjacent to and abuts an upper edge of the girdle. Each of the plurality of lower girdle facets is disposed adjacent to and abuts a lower edge of the girdle.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has an octagon-shaped cross-section. The gemstone has a top depth percentage between about 23.5% and about 32%, and a bottom depth percentage between about 47.5% and about 51.5%.

According to some implementations of the present disclosure, a gemstone comprises a crown, a pavilion, and a girdle. The crown forms an upper portion of the gemstone. The pavilion forms a lower portion of the gemstone. The girdle is positioned between the crown and the pavilion, and encircles the gemstone. The girdle has an octagon-shaped cross-section. The gemstone has a total depth percentage between about 80% and about 89%.

According to some implementations of the present disclosure, a gemstone comprises a crown forming an upper portion of the gemstone and a pavilion forming a lower portion of the gemstone. The surface of the crown is defined by a first plurality of facets, each of the first plurality of facets being disposed at an angle between about 12° and about 59° relative to an upper surface of the gemstone. The surface of the pavilion is defined by a second plurality of facets, each of the second plurality of facets being disposed at an angle between about 36° and about 58° relative to the upper surface of the gemstone.

According to some implementations of the present disclosure, a method of forming a crown of a gemstone comprises forming a first preliminary table on an upper portion of the gemstone, the first preliminary table being a generally horizontal upper surface; forming a first temporary set of crown facets on the upper portion of the gemstone, the first temporary set of crown facets being formed at an angle of between about 45.5° and about 49.5° relative to the first preliminary table; forming a second temporary set of crown facets on the upper portion of the gemstone from portions of the first preliminary table and the first temporary set of crown facets, the second temporary set of crown facets being formed at an angle of between about 28° and about 36.5° relative to the generally horizontal upper surface, a remainder of the first preliminary table forming a second preliminary table, a remainder of the first temporary set of crown facets forming a third temporary set of crown facets; forming a fourth temporary set of crown facets on the upper portion of the gemstone from portions of the second preliminary table and the second temporary set of crown facets, the fourth temporary set of crown facets being formed at an angle of between about 16.5° and about 23° relative to the generally horizontal upper surface, a remainder of the second preliminary table forming a third preliminary table, a remainder of the second set of temporary crown facets forming a first final set of crown facets; forming a second final set of crown facets on the upper portion of the gemstone from portions of the third temporary set of crown facets, the second final set of crown facets being formed at an angle of between about 52° and about 59° relative to the generally horizontal upper surface, a remainder of the third temporary set of crown facets forming a third final set of crown facets; and forming a fourth final set of crown facets on the upper portion of the gemstone from portions of the third preliminary table and the fourth temporary set of crown facets, the fourth final set of crown facets being formed at an angle of between about 12° and about 16° relative to the generally horizontal upper surface, a remainder of the third preliminary table forming a final table of the gemstone, a remainder of the fourth temporary set of crown facets forming a fifth final set of crown facets, such that the upper portion of the gemstone is formed from the final table and the first, second, third, fourth, and fifth final set of crown facets.

According to some implementations of the present disclosure, a method of forming a pavilion of a gemstone having a horizontal upper surface comprises forming a first temporary set of pavilion facets on a lower portion of the gemstone, the first temporary set of pavilion facets being formed at an angle of between about 45.5° and about 49° relative to the horizontal upper surface; forming a second temporary set of pavilion facets on the lower portion of the gemstone from portions of the first temporary set of pavilion facets, the second temporary set of pavilion facets being formed at an angle of between about 36° and about 40.5°, a remainder of the first temporary set of pavilion facets forming a third temporary set of pavilion facets; forming a fourth temporary set of pavilion facets on the lower portion of the gemstone from portions of the second temporary set of pavilion facets and the third temporary set of pavilion facets, the fourth temporary set of pavilion facets being formed at an angle of between about 42° and about 46.5° relative to the horizontal upper surface, a remainder of the second temporary set of pavilion facets forming a first final set of pavilion facets, a remainder of the third temporary set of pavilion facets forming a fifth temporary set of pavilion facets; and forming a second final set of pavilion facets on the lower portion of the gemstone from portions of the fourth temporary set of pavilion facets and the fifth temporary set of pavilion facets, the second final set of pavilion facets being formed at an angle of between about 50.5° and about 58° relative to the horizontal upper surface, a remainder of the fourth temporary set of pavilion facets forming a third final set of pavilion facets, a remainder of the fifth temporary set of pavilion facets forming a fourth final set of pavilion facets, such that the lower portion of the gemstone is formed from the first, second, third, and fourth final set of pavilion facets.

The foregoing and additional aspects and implementations of the present disclosure will be apparent to those of ordinary skill in the art in view of the detailed description of various embodiments and/or implementations, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

Figure 1:
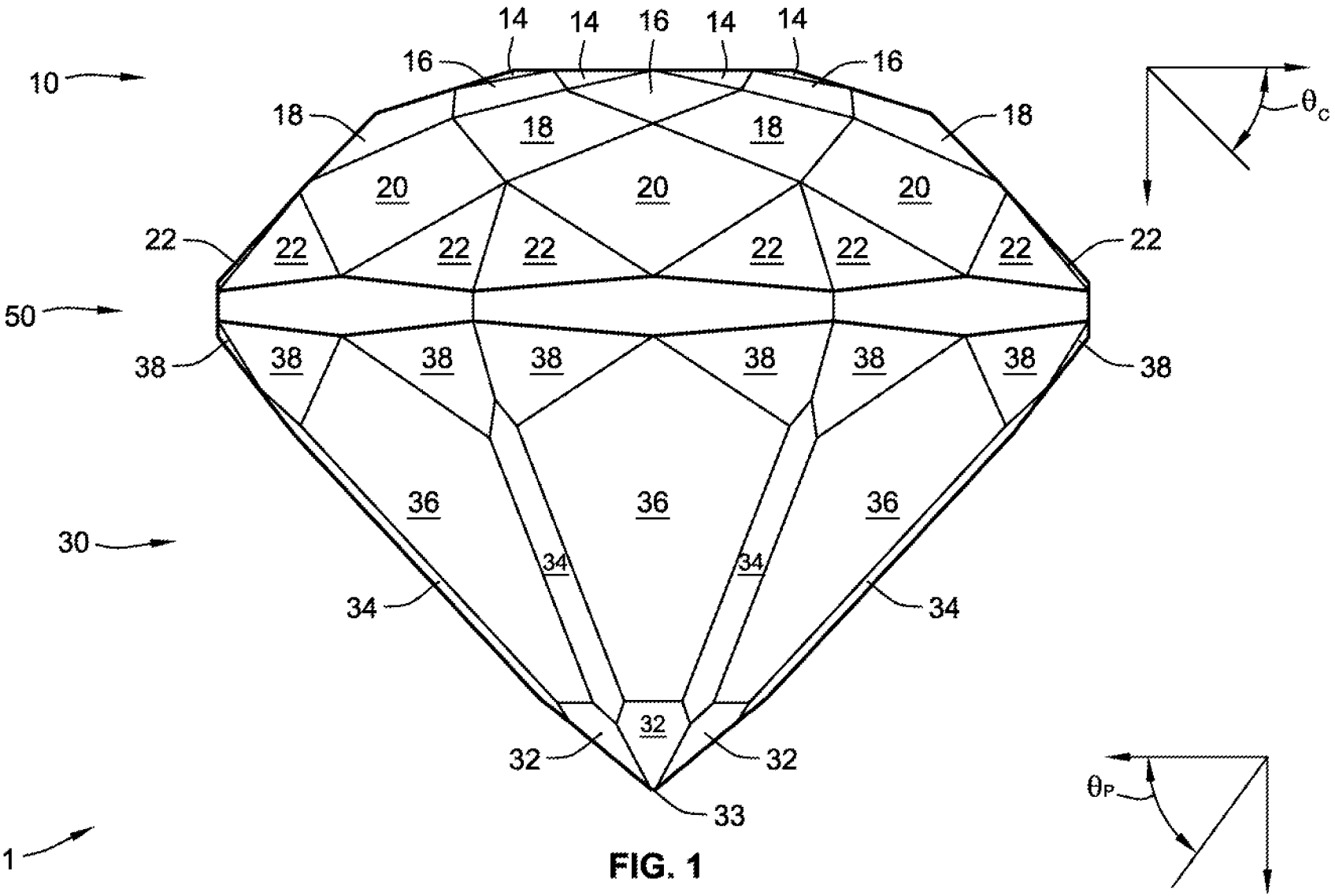
FIG. 1 is an elevation view of a gemstone, according to some implementations of the present disclosure.

While the present disclosure is susceptible to various modifications and alternative forms, specific implementations and embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the present disclosure as defined by the appended claims.

DETAILED DESCRIPTION

Figure 2:
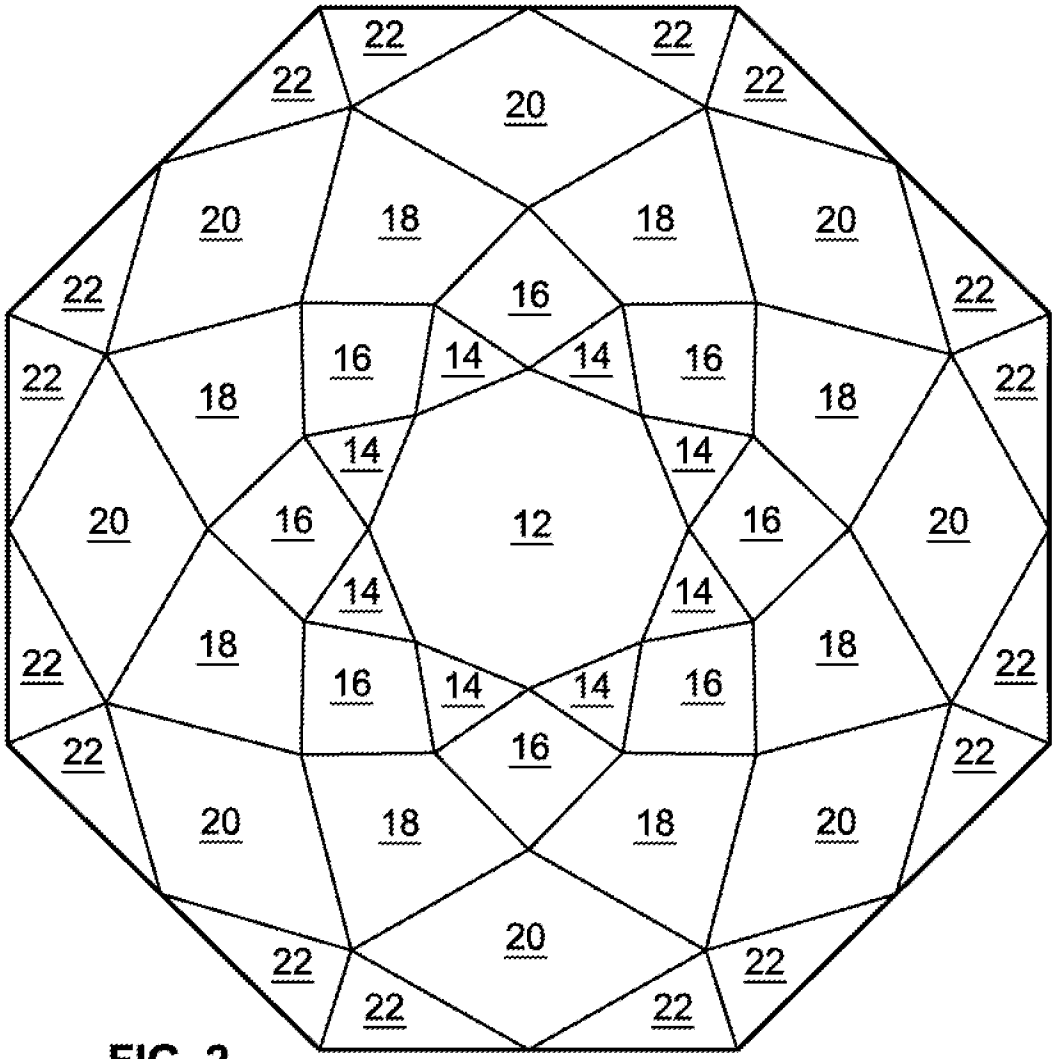
FIG. 2 is a top plan view of the gemstone of FIG. 1, according to some implementations of the present disclosure.

FIG. 1 illustrates elevation views of an implementation of the gemstone 1. The gemstone 1 is generally divided into a crown 10 formed as the upper portion of the gemstone 1, a pavilion 30 formed as the lower portion of the gemstone 1, and a girdle 50, which is generally disposed between the crown 10 and the pavilion 30. The girdle 50 generally encircles the entire circumference of the gemstone 1. The crown 10 generally has a flat top surface (as seen in FIG. 2), referred to as a table 12. The lower portion of the gemstone 1 at the pavilion 30 can terminate in a lower point 33 as shown in FIG. 1, or can terminate in a flat facet called a culet. The gemstone 1 is generally a precious stone, such as but not limited to a diamond, ruby, emerald, sapphire, or pearl. The gemstone 1 can also be a synthetic material, such as cubic zirconium. More broadly, the gemstone 1 can include any material capable of being cut, such as, for example, precious or non-precious stones, cubic zirconia, ceramic, metal, plastic, wood, etc.

The girdle 50 is generally the widest portion of the gemstone 1. When the gemstone 1 is viewed from above or below (e.g., the view in FIGS. 2 and 3, respectively), the girdle 50 defines the outer perimeter of the gemstone 1. The gemstone 1 has a generally octagonal shape with eight sides and thus, the girdle 50 and the perimeter of the gemstone 1 have an octagonal cross-section.

The dimensional characteristics of the gemstone 1 are based off of the width of the gemstone 1. The width of the gemstone 1 can also be expressed as the diameter of the girdle 50. The gemstone 1 has a table percentage that is a measure of a width or diameter of the table of the gemstone 1. The table can be formed in a variety of shapes, as thus the measure of the width of the table can vary. In the illustrated implementation, the table is an octagon, and either the distance between opposing edges of the octagon or between opposing vertices of the octagon is used to express the table percentage. In another implementation, the table is a circle, and thus the diameter of the circle is used to express the table percentage of the gemstone 1. The table percentage is generally expressed as the width of the table 12 divided by the width of the gemstone 1. In an implementation, the table percentage is between about 31% and about 34%. In a further implementation, the table percentage is between about 29% and about 36%. In an additional implementation, the table percentage is between about 25% and about 40%. In yet a further implementation the table percentage is about 33.5%.

The gemstone 1 has a top depth percentage that is a measure of the height of the crown 10 of the gemstone 1. The top depth percentage is generally expressed as the height of the crown 10 divided by the width of the gemstone 1. In an implementation, the top depth percentage is between about 23.5% and about 32%. In another implementation, the top depth percentage is between about 20% and about 35%. In a further implementation, the top depth percentage is between about 15% and about 40%. In yet a further implementation the top depth percentage is about 28.%.

The gemstone 1 has a bottom depth percentage that is a measure of the total height of the pavilion 30 of the gemstone 1. The bottom depth percentage is generally expressed as the height of the pavilion 30 divided by the width of the gemstone 1. In an implementation, the bottom depth percentage is between about 47.5% and about 51.5%. In another implementation, the bottom depth percentage is between about 45% and about 55%. In yet a further implementation the bottom depth percentage is about 49.5%.

The gemstone 1 has a girdle thickness percentage that is a measure of the total height of the girdle 50 of the gemstone 1. The girdle thickness percentage is generally expressed as the height of the girdle 50 divided by the width of the gemstone 1. In an implementation, the girdle thickness percentage is between about 3.5% and about 7%. In another implementation, the girdle thickness percentage is between about 2% and about 10%. In a further implementation the girdle thickness percentage is about 5%.

The gemstone 1 has a total depth percentage that is a measure of the total height of the gemstone 1. The total depth percentage is generally expressed as the height of the gemstone 1 divided by the width of the gemstone 1. The total depth percentage may also be expressed as the sum of the top depth percentage, the bottom depth percentage, and the girdle thickness percentage. In an implementation, the total depth percentage is between about 80% and about 89%. In another implementation, the total depth percentage is between about 75% and about 95%. In a further implementation the total depth percentage is about 84.5%.

The surface of the gemstone 1 is generally divided into a number of groups of interlocking facets disposed at a variety of angles. The facets comprising the surface of the crown 10 generally include a table 12, star facets 14, upper intermediate crown facets 16, lower intermediate crown facets 18, main crown facets 20, and upper girdle facets 22. The upper girdle facets 22 generally abut an upper edge of the girdle 50.

The groups of facets comprising the surface of the pavilion 30 include culet-adjacent facets 32, candle facets 34, main pavilion facets 36, and lower girdle facets 38. The lower girdle facets 38 generally abut a lower edge of the girdle 50.

In one implementation, the girdle 50 is divided into eight sub-facets that encircle the gemstone 1. In another implementation, the girdle 50 is a continuous circular facet that encircles the entirety of the gemstone 1. In yet another implementation, each sub-facet of the girdle 50 comprises a plurality of individual facets. The upper edge of the girdle 50 that abuts the crown 10 may be generally straight or may be curved. The lower edge of the girdle 50 that abuts the pavilion 30 may be generally straight or may be curved.

The angles that each of the facets of the crown 10 are disposed at may be measured relative to a horizontal plane defined by the table of the gemstone 1 (e.g. the top surface of the gemstone 1). As shown in the upper set of axes in FIG. 1, each of the facets of the crown 10 is formed at an angle $\theta_C$ relative to the horizontal plane defined by the table of the gemstone 1. As is shown in FIG. 1, the angle $\theta_C$ that each of the facets of the crown 10 are disposed at is formed by rotating in a clockwise direction downward from the horizontal plane defined by the table. (e.g., the table is at an angle of 0°).

Generally, every facet within a group of facets is disposed at the same angle or at an angle within the same range. For example, all of the star facets 14 are disposed at the same angle or at an angle within the same range. In some implementations, the range of angles for different groups of facets can overlap, such that two facets within two different groups of facets may have identical or substantially identical angles. Generally, each facets within a group of facets (e.g., all of the star facets, all of the main crown facets, etc.) has the same shape.

In an implementation, the angle of each of the star facets 14 is between about 12° and about 16°. In another implementation, the angle of each of the star facets 14 is between about 10° and about 20°. In a further implementation, the angle of each of the star facets 14 is about 14°.

In an implementation, the angle of each of the upper intermediate crown facets 16 is between about 16.5° and about 23°. In another implementation, the angle of each of the upper intermediate crown facets 16 is between about 15° and about 25°. In a further implementation, the angle of each of the upper intermediate crown facets 16 is between about 10° and about 30°. In yet another implementation, the angle of each of the upper intermediate crown facets 16 is between about 20° and about 22°.

In an implementation, the angle of each of the lower intermediate crown facets 18 is about between about 28° and about 36°. In another implementation, the angle of each of the lower intermediate crown facets 18 is between about 25° and about 40°. In a further implementation, the angle of each of the lower intermediate crown facets 18 between about 20° and about 45°. In yet another further implementation, the angle of each of the lower intermediate crown facets 18 is about 32°.

In an implementation, the angle of each of the main crown facets 20 is between about 45.5° and about 49.5°. In another implementation, the angle of each of the main crown facets 20 is between about 45° and about 50°. In a further implementation, the angle of each of the main crown facets 20 is between about 40° and about 55°. In yet another implementation, the angle of each of the main crown facets 20 is about 47.5°.

In an implementation, the angle of each of the upper girdle facets 22 is between about 52° and about 59°. In a further implementation, the angle of each of the upper girdle facets 22 is between about 50° and about 65°. In a further implementation, the angle of each of the upper girdle facets 22 is between about 55° and about 70°. In yet another implementation, the angle of each of the upper girdle facets 22 is about 55.5°.

The angles that each of the facets of the pavilion 30 are disposed at may also be measured relative to the horizontal plane defined by the table of the gemstone 1 (e.g. the top surface of the gemstone 1). As shown in the lower set of axes in FIG. 1, each of the facets of the pavilion 30 is formed at an angle $\theta_P$ relative to this horizontal plane defined by the table of the gemstone 1. As is shown in FIG. 1, the angle $\theta_P$ that each of the facets of the pavilion 30 are disposed at is formed by rotating in a counterclockwise direction upward from the horizontal plane defined by the table.

In an implementation, the angle of each of the culet-adjacent facets 32 is between about 36° and about 40.5°. In another implementation, the angle of each of the culet-adjacent facets 32 is between about 30° and about 45°. In a further implementation, the angle of each of the culet-adjacent facets 32 is about 38°.

In an implementation, the angle of each of the candle facets 34 is between about 42° and about 46.5°. In another implementation, the angle of each of the candle facets 34 is between about 40° and about 50°. In a further implementation, the angle of each of the candle facets 34 is about 44°.

In an implementation, the angle of each of the main pavilion facets 36 is between about 45.5° and about 49°. In another implementation, the angle of each of the main pavilion facets 36 is between about 40° and about 55°. In a further implementation, the angle of each of the main pavilion facets 36 is about 47°.

In an implementation, the angle of the lower girdle facets 38 is between about 50.5° and about 58°. In another implementation, the angle of the lower girdle facets 38 is between about 50° and about 60°. In a further implementation, the angle of the lower girdle facets 38 is between about 45° and about 65°. In yet another implementation, the angle of the lower girdle facets 38 is about 54°.

Referring now to FIG. 2, a top plan view of the gemstone 1 showing the crown 10 is illustrated. The crown 10 forms the upper portion of the gemstone 1, and includes a variety of facets that share edges and vertices where facets meet. When describing the facets on the surface of the crown 10, the term "upper" is used to refer to edges or vertices nearer to the table 12, while the term "lower" is used to refer to edges or vertices nearer to the girdle 50. The terms "top," "bottom," "left," "right," "above," below," etc. are used herein to refer to the locations of the various facets on the crown 10. However, those of skill in the art will understand that these are relative terms that are generally used in reference to the plane of FIG. 2. Thus, any of these terms used to describe an individual facet may not apply when viewing the crown 10 from a different perspective.

The crown 10 includes eight main crown facets 20. Each main crown facet is generally disposed between two of the lower intermediate crown facets 18, and two of the upper girdle facets 22. Each main crown facet 20 is generally diamond or kite-shaped (e.g., four sides) with four edges and four vertices. Each main crown facet 20 shares a first edge with a first adjacent upper girdle facet 22, a second edge with a second adjacent upper girdle facet 22, a third edge with a first adjacent lower intermediate crown facet 18, and a fourth edge with a second adjacent lower intermediate crown facet 18.

The four vertices of each main crown facet 20 includes an upper vertex, a lower vertex, and two lateral vertices. The lower vertex of each main crown facet 20 abuts the upper edge of the girdle, as well as a lower vertex of two adjacent upper girdle facets 22. The upper vertex of each main crown facet 20 abuts a lower vertex of an adjacent upper intermediate crown facet 16, and a lateral vertex of each of two adjacent lower intermediate crown facets 18. The two lateral vertices of each main crown facet 20 each abut a lateral vertex of an adjacent main crown facet 20, a lower vertex of an adjacent lower intermediate crown facet 18, and the upper vertex of two adjacent upper girdle facets 22. Generally, each main crown facet 20 is surrounded by one of the upper intermediate crown facets 16, two of the lower intermediate crown facets 18, two of the main crown facets 20, two of the upper girdle facets 22, and the girdle 50.

The crown 10 includes sixteen upper girdle facets 22. Each upper girdle facet 22 has a generally triangular shape with a first edge, a second edge, and a third edge. The first edge of each of the upper girdle facets 22 is shared with the girdle 50, and can be flat or curved depending on the shape of the girdle 50. In the illustrated implementation, the first edge of each of the upper girdle facets 22 is flat. As shown, the upper girdle facets 22 are formed in pairs. Each pair of upper girdle facets 22 is disposed between two adjacent main crown facets 20, and the upper edge of the girdle 50. Within each pair of upper girdle facets 22, the second edge of one of the upper girdle facets 22 is shared with one of the adjacent main crown facets 20, and the second edge of the other upper girdle facet 22 is shared with the other adjacent main crown facet 20. A third edge of each upper girdle facet 22 within the pair is shared with the other upper girdle facet 22 within the pair.

Each upper girdle facet 22 has two lower vertices and an upper vertex. One of the lower vertices of each upper girdle facet 22 within a pair of upper girdle facets 22 abuts (i) the upper edge of the girdle, and (ii) one of the lower vertices of the other upper girdle facet 22 in the pair. The other lower vertex of each upper girdle facet 22 in each pair of upper girdle facets 22 abuts (i) the upper edge of the girdle, (ii) the lower vertex of one of the main crown facets 20, and (iii) a lower vertex of an upper girdle facet 22 in an adjacent pair of upper girdle facets 22. The upper vertex of each upper girdle facet 22 within each pair of upper girdle facets 22 abuts (i) the upper vertex of the other upper girdle facet 22 within the pair, (ii) one of the lateral vertices of both of the main crown facets 20 between which the pair of upper girdle facets 22 is disposed, and (iii) a lower vertex of one of the lower intermediate crown facets 18. Generally, each upper girdle facet 22 is surrounded by one of the lower intermediate crown facets 18, two of the main crown facets 20, two of the upper girdle facets 22, and the girdle 50.

The crown 10 includes eight lower intermediate crown facets 18. Each lower intermediate crown facet 18 is disposed generally between two of the upper intermediate crown facets 16, and two of the main crown facets 20. Each lower intermediate crown facet 18 is generally diamond or kite-shaped (e.g., four sides) with four edges and four vertices. Each lower intermediate crown facet 18 shares a first edge with a first adjacent main crown facet 20, a second edge with a second adjacent main crown facet 20, a third edge with a first adjacent upper intermediate crown facet 16, and a fourth edge with a second adjacent upper intermediate crown facet 16.

The four vertices of each lower intermediate crown facet 18 includes an upper vertex, a lower vertex, and two lateral vertices. The lower vertex of each lower intermediate crown facet 18 abuts one of the lateral vertices of each of two adjacent main crown facets 20, as well as the upper vertex of each of a pair of upper girdle facets 22. The upper vertex of each of the lower intermediate crown facets 18 abuts a lateral vertex of each of two adjacent upper intermediate crown facets 16, as well as a lower vertex of one of the star facets 14. The two lateral vertices of each lower intermediate crown facet 18 each abut a lateral vertex of an adjacent lower intermediate crown facet 18, the upper vertex of an adjacent main crown facet 20, and a lower vertex of an adjacent upper intermediate crown facet 16. Generally, each lower intermediate crown facet 18 is surrounded by one of the star facets 14, two of the upper intermediate crown facets 16, two of the lower intermediate crown facets 18, two of the main crown facets 20, and two of the upper girdle facets 22.

The crown 10 includes eight upper intermediate crown facets 16. Each of the upper intermediate crown facets 16 is disposed generally between two of the star facets 14, and two of the lower intermediate crown facets 18. Each upper intermediate crown facet 16 is generally diamond or kite-shaped (e.g., four sides) with four edges and four vertices. Each upper intermediate crown facet 16 shares a first edge with a first adjacent lower intermediate crown facet 18, a second edge with a second adjacent lower intermediate crown facet 18, a third edge with a first adjacent star facet 14, and a fourth edge with a second adjacent star facet 14.

The four vertices of each upper intermediate crown facet 16 includes an upper vertex, a lower vertex, and two lateral vertices. The lower vertex of each upper intermediate crown facet 16 abuts a lateral vertex of each of two adjacent lower intermediate crown facets 18, as well as the upper vertex of one of the main crown facets 20. The upper vertex of each of the upper intermediate crown facets 16 abuts a lateral vertex of each of two adjacent star facets 14, as well as a vertex of the table 12. The two lateral vertices of each upper intermediate crown facet 16 each abut a lateral vertex of an adjacent upper intermediate crown facet 16, the upper vertex of an adjacent lower intermediate crown facet 18, and a lower vertex of an adjacent star facet 14. Generally, each upper intermediate crown facet 16 is surrounded by the table 12, two of the star facets 14, two of the upper intermediate crown facets 16, two of the lower intermediate crown facets 18, and one of the main crown facets 20.

The crown 10 includes eight star facets 14. Each star facet 14 is disposed adjacent to and abutting an edge of the table 12. All of the star facets 14 are generally triangle-shaped with three vertices and three edges. A lower vertex of each of the star facets 14 abuts the upper vertex of one of the lower intermediate crown facets 18, and a lateral vertex of each of two adjacent upper intermediate crown facets 16. The two upper vertices of each star facet 14 each abut the upper vertex of one of the upper intermediate crown facets 16, one of the upper vertices of an adjacent star facet 14, and a vertex of the table 12.

A first edge of each star facet 14 is shared with one edge of an adjacent upper intermediate crown facet 16. A second edge of each star facet 14 is shared with one edge of a second adjacent upper intermediate crown facets 16. A third edge of each star facet 14 is shared with the table 12. Generally, each star facet 14 is surrounded by the table 12, two of the star facets 14, two of the upper intermediate crown facets 16, and one of the lower intermediate crown facets 18.

The table 12 is a generally horizontal surface having a number of edges and is located at the top of the crown 10. In the implementation illustrated in FIG. 2, table 12 has a generally octagonal shape with eight edges and eight vertices. Each edge of the table 12 is shared with an edge of one of the star facets 14. Each vertex of the table abuts the upper vertex of one of the upper intermediate crown facets 16, as well as one of the upper vertices of two adjacent star facets 14. Other shapes for table 12 are contemplated in other implementations. Generally, the table 12 is surrounded by all of the star facets 14 and all of the upper intermediate crown facets 16.

Figure 3:
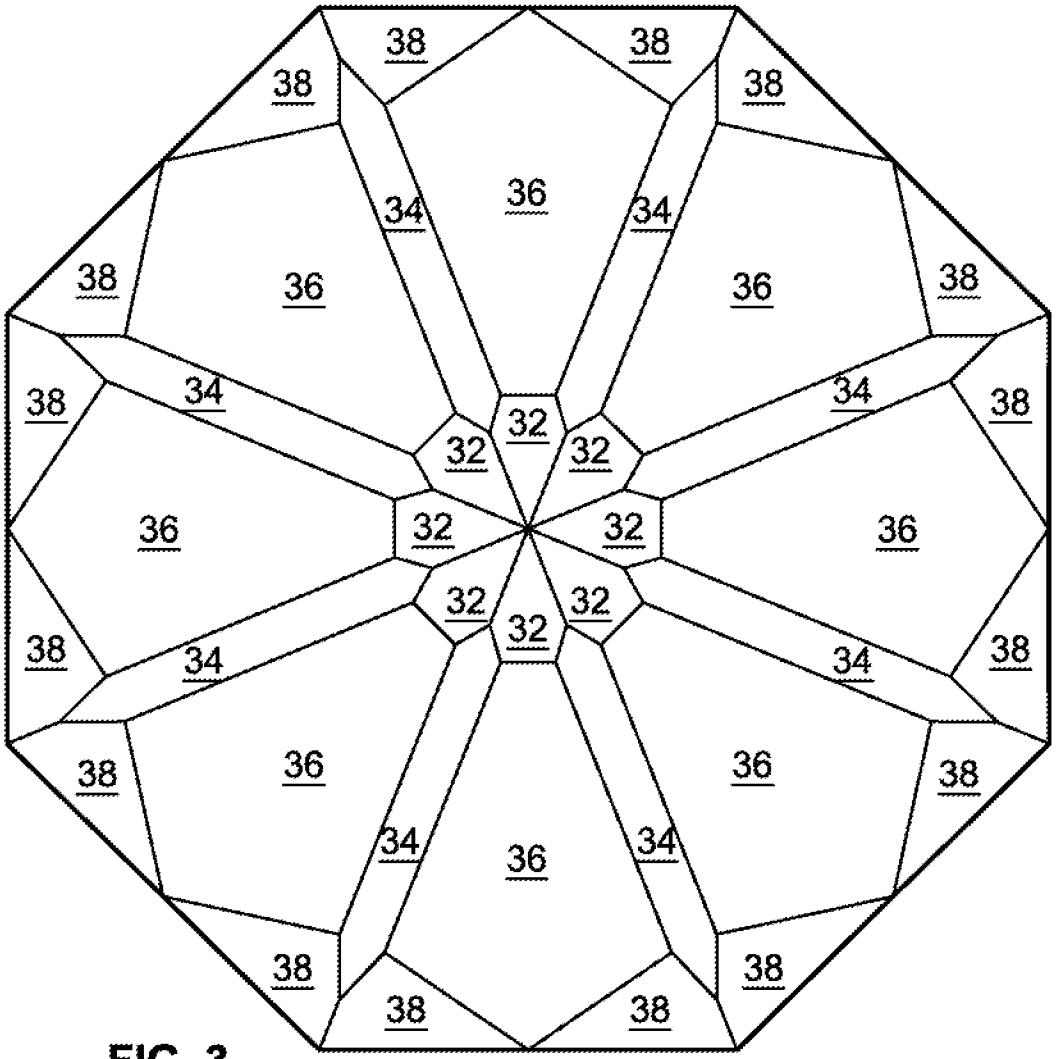
FIG. 3 is a bottom plan view of the gemstone of FIG. 1, according to some implementations of the present disclosure.

Referring now to FIG. 3, a bottom plan view of the gemstone 1 showing the pavilion 30 is illustrated. The pavilion 30 forms the lower portion of the gemstone 1, and includes a variety of facets that share edges and vertices where facets meet. When describing the facets on the surface of the pavilion 30, the term "lower" is used to refer to edges or vertices nearer to the lower point 33 (see FIG. 1), while the term "upper" is used to refer to edges or vertices nearer to the girdle 50. The terms "top," "bottom," "left," "right," "above," below," etc. are used herein to refer to the locations of the various facets on the pavilion 30. However, those of skill in the art will understand that these are relative terms that are generally used in reference to the plane of FIG. 3. Thus, any of these terms used to describe an individual facet may not apply when viewing the pavilion 30 from a different perspective.

The pavilion 30 includes eight main pavilion facets 36. Each main pavilion facet 36 is disposed generally between two of the plurality of candle facets 34. Each main pavilion facet 36 is generally diamond or kite-shaped with a flattened lower edge. Thus, each main pavilion facet 36 has a pentagon shape with five edges. The main pavilion facets 36 thus have one upper vertex, two lower vertices, and two lateral vertices. The upper vertex of each main pavilion facet 36 abuts the lower edge of the girdle, as well as an upper vertex of each of two adjacent lower girdle facets 38. The two lateral vertices of each main pavilion facet 36 abut an upper-lateral vertex of adjacent candle facets 34. The two lower vertices of each main pavilion facet 36 each abut a lower-lateral vertex of an adjacent candle facet 34, and two upper vertices of a single corresponding culet-adjacent facet 32. Each main pavilion facet 36 shares first and second edges with two adjacent lower girdle facets 38, third and fourth edges with two adjacent candle facets 34, and a fifth edge (the lower edge) with the upper edge of the single corresponding culet-adjacent facet 32. Generally, each main pavilion facet 36 is surrounded by one of the culet-adjacent facets 32, two of the candle facets 34, two of the lower girdle facets 38, and the girdle 50.

The pavilion 30 includes sixteen lower girdle facets 38. Each lower girdle facet 38 is disposed generally between two of the main pavilion facets 36 and the girdle 50. Each of the lower girdle facets 38 has four edges. A first edge of each of the lower girdle facets 38 is shared with the girdle 50, and can be flat or curved depending on the shape of the girdle 50. As shown, the lower girdle facets 38 are formed in pairs (similar to the upper girdle facets 22). Each pair of lower girdle facets 38 is disposed between two of the main pavilion facets 36, one of the candle facets 34, and the lower edge of the girdle 50. Within each pair of lower girdle facets 38, a second edge of one of the lower girdle facets 38 is shared with one of the main pavilion facets 36, and a second edge of the other lower girdle facet 38 is shared with the other main pavilion facet 36. A third edge of each lower girdle facet 38 within the pair of lower girdle facets 38 is shared with the other lower girdle facet 38 within the pair. A fourth edge of each lower girdle facet 38 abuts an edge of one of the candle facets 34. As shown, the lower portions of the lower girdle facets 38 of each pair of lower girdle facets 38 form a gap into which an upper portion of the candle facets 34 extends.

Each lower girdle facet 38 has two lower vertices and two upper vertices. One of the lower vertices of each lower girdle facet 38 in the pair of lower girdle facets 38 abuts (i) an upper vertex of one of the candle facets 34, and (ii) a corresponding lower vertex of the other lower girdle facet 38 in the pair. The other lower vertex of each lower girdle facet 38 in the pair of lower girdle facets 38 abuts an upper-lateral vertex of one of the candle facets 34, and a lateral vertex of one of the main pavilion facets 36. One of the upper vertices of each lower girdle facet 38 in the pair of lower girdle facets 38 abuts (i) the lower edge of the girdle 50, and (ii) a corresponding upper vertex of the other lower girdle facet 38 in the pair. The other upper vertex of each lower girdle facet 38 in the pair of lower girdle feac4tes 38 abuts (i) the lower edge of the girdle 50, (ii) the upper vertex of one of the main pavilion facets 36, and (iii) a corresponding upper vertex of a lower girdle facet 38 in an adjacent pair of lower girdle facets 38 (e.g., not in the pair of lower girdle facets 38). Generally, each lower girdle facet 38 is surrounded by one of the candle facets 34, one of the main pavilion facets 36, one of the lower girdle facets 38, and the girdle 50.

Eight culet-adjacent facets 32 are formed at the lowermost portion of the pavilion 30. Each culet-adjacent facet 32 is generally diamond or kite-shape with a flatted upper edge. Thus, each culet-adjacent facet 32 has a generally pentagonal shape with a lower vertex, two lateral vertices, and two upper vertices. An upper flat edge is opposite the lower vertex of each culet-adjacent facet 32. In some implementations, the culet-adjacent facets 32 terminate in a culet, which is a horizontal surface forming the bottom of the pavilion 30. In the implementation illustrated in FIG. 3, each of the culet-adjacent facets 32 has a bottom vertex. Together, the bottom vertices of each of the culet-adjacent facets 32 form the lower point 33 of the gemstone 1 (see FIG. 1).

The two lateral vertices of each culet-adjacent facet 32 each abut (i) a lower vertex of an adjacent candle facet 34 and, (ii) a lateral vertex of an adjacent culet-adjacent facet 32. The two upper vertices of each culet-adjacent facet 32 each abut (i) a lower-lateral vertex of an adjacent candle facet 34, and (ii) a lower vertex of an adjacent main pavilion facet 36. Each culet-adjacent facet 32 shares two edges with two adjacent culet-adjacent facets 32, two edges with two adjacent candle facets 34, and one edge with an adjacent main pavilion facet 36. Generally, each culet-adjacent facet 32 is surrounded by two other culet-adjacent facets 32, two candle facets 34, and one main pavilion facet 36.

Eight candle facets 34 are formed on the surface of the pavilion 30. Each of the candle facets 34 is disposed generally between two of the main pavilion facets 36. Each candle facet 34 has six edges and six vertices. Each candle facet 34 shares two edges with two of the main pavilion facets 36, two edges with two of the culet-adjacent facets, and two edges with a pair of the lower girdle facets 38.

The six vertices of the candle facets 34, include an upper vertex, two upper-lateral vertices, two lower-lateral vertices, and a lower vertex. The upper vertex of each candle facet 34 abuts one of the upper vertices of each of a pair of lower girdle facets 38, and the upper portion of each candle facet 34 (which includes the upper vertex) is slotted between that same pair of lower girdle facets 38. The lower vertex of each candle facet 34 abuts one of the lateral vertices of each of a pair of culet-adjacent facets 32, and the lower portion of each candle facet 34 (which includes the lower vertex) is slotted between that same pair of culet-adjacent facets 32.

One upper-lateral vertex of each candle facet 34 abuts the other upper vertex of one of the lower girdle facets 38 of the same pair of lower girdle facets 38. The other upper-lateral vertex of each candle facet 34 abuts the other upper vertex of the other lower girdle facet 38 of the same pair of lower girdle facets 38. The upper-lateral vertices of each candle facet 34 also each abut one of the lateral vertices of one adjacent main pavilion facet 36.

Similarly, one lower-lateral vertex of each candle facet 34 abuts the upper vertex of one of the culet-adjacent facets 32 of the same pair of culet-adjacent facets 32. The other lower-lateral vertex of each candle facet 34 abuts the upper vertex of the other culet-adjacent facet 32 of the same pair of culet-adjacent facets 32. The lower-lateral vertices of each candle facet 34 also each abut one of the lower vertices of one adjacent main pavilion facet 36. Each candle facet 34 is positioned between and generally surrounded by (i) two of the main pavilion facets 36, (ii) two of the culet-adjacent facets 32, and (iii) a pair of lower girdle facets 38.

Figure 4A:
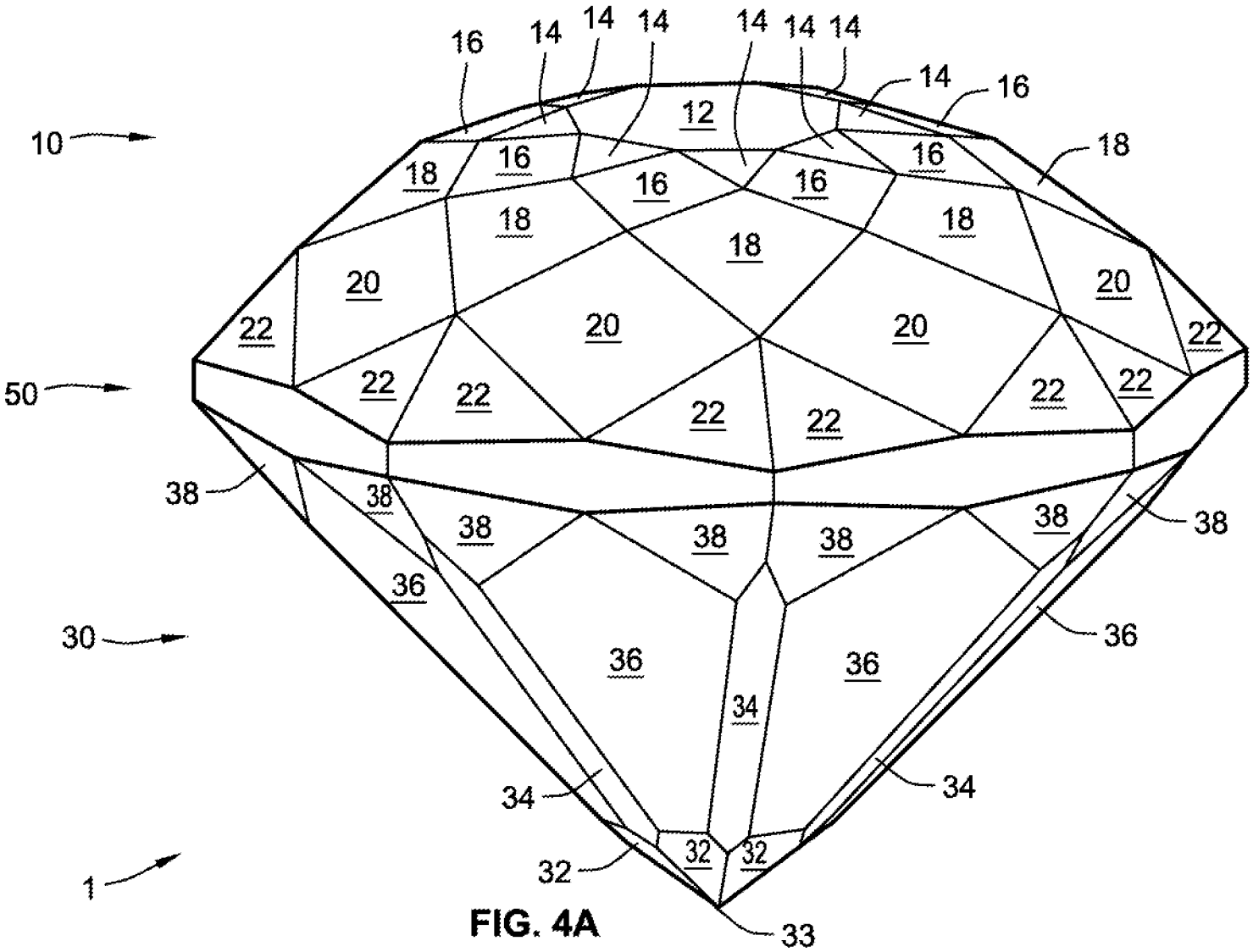
FIG. 4A is a perspective view of the gemstone of FIG. 1 viewed at a downward angle, according to some implementations of the present disclosure.
Figure 4B:
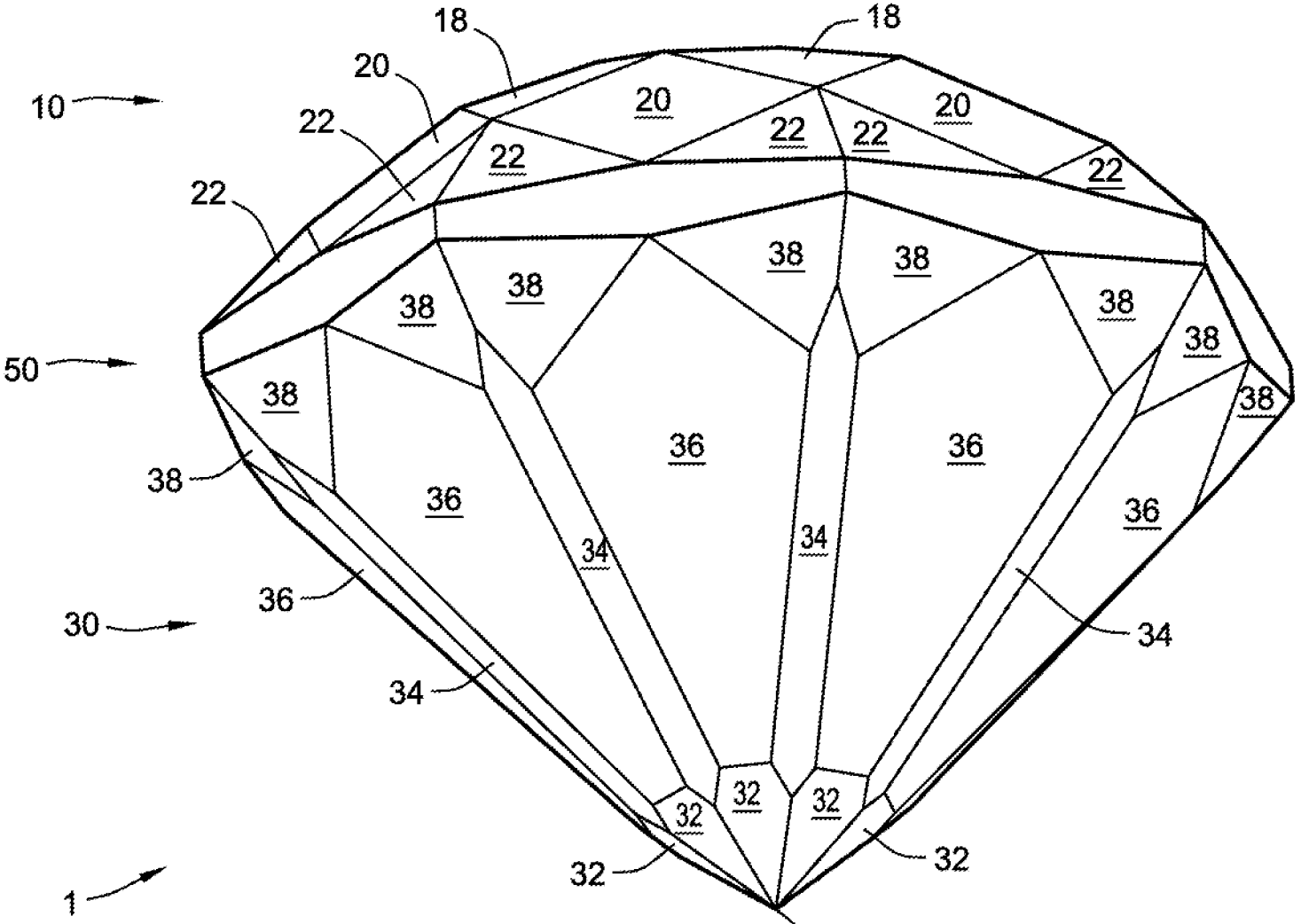
FIG. 4B is a perspective view of the gemstone of FIG. 1 viewed at an upward angle, according to some implementations of the present disclosure.

FIG. 4A illustrates a perspective view of gemstone 1 at a downward angle, while FIG. 4B illustrates a perspective view of gemstone 1 at an upward angle. These figures show the table 12, the star facets 14, the upper intermediate crown facets 16, the lower intermediate crown facets 18, the main crown facets 20, the upper girdle facets 22, the culet-adjacent facets 32, the candle facets 34, the main pavilion facets 36, the lower girdle facets 38, and the girdle 50.

Figure 5A:
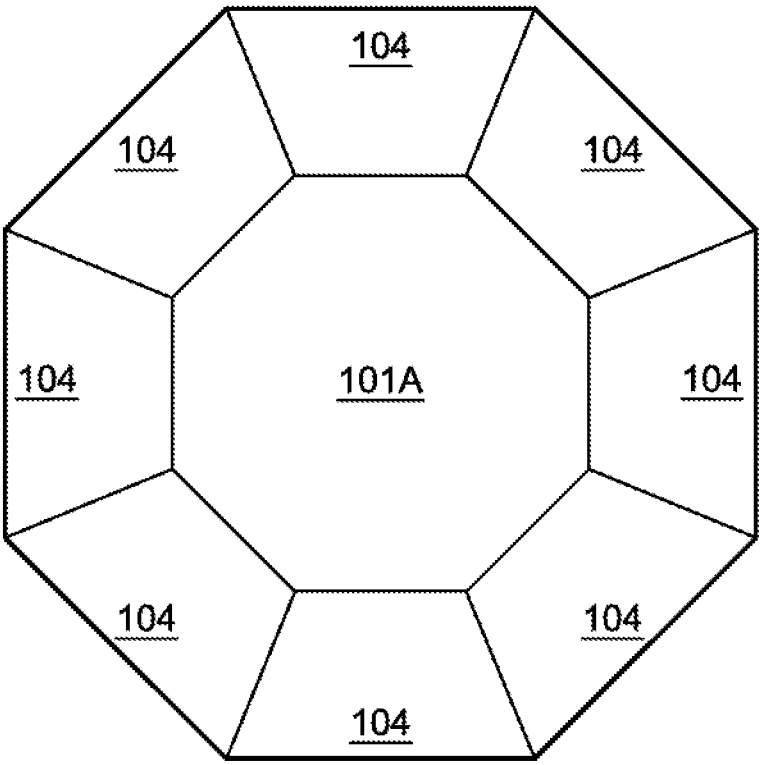
FIG. 5A illustrates a first step of a method of forming a crown of the gemstone of FIG. 1, according to some implementations of the present disclosure.

Referring now to FIGS. 5A-5E, the steps for forming the crown of the gemstone are illustrated. Generally, the gemstone may be formed from an uncut sample, which can have any shape. As shown in FIG. 5A, the first step includes forming a first preliminary table 101A and a first set of crown facets 104 (e.g., a first temporary set of crown facets). In an implementation, the width of the first preliminary table 101A is formed to be the same as the table 102 of the final gemstone, and thus is between about 29% and about 36% of the width of the gemstone, between about 31% and about 34% of the width of the gemstone, or about 32.5% of the width of the gemstone. In other implementations, the width of the first preliminary table 101A is larger than the width of the table 102 of the final gemstone, and is reduced in subsequent steps.

The facets of the first set of crown facets 104 are formed at an angle of between about 45.5° and about 49.5°, and are generally formed in a circular pattern about the crown 10 of the gemstone. The angle of the first set of crown facets 104 and the angles of other crown facets formed in subsequent steps are measured relative to the horizontal plane that is defined by the first preliminary table 101A, similar to how the angles of the facets of the completed crown were measured in FIG. 1. After this step, the crown of the gemstone includes the first preliminary table 101A and the first set of crown facets 104.

Figure 5B:
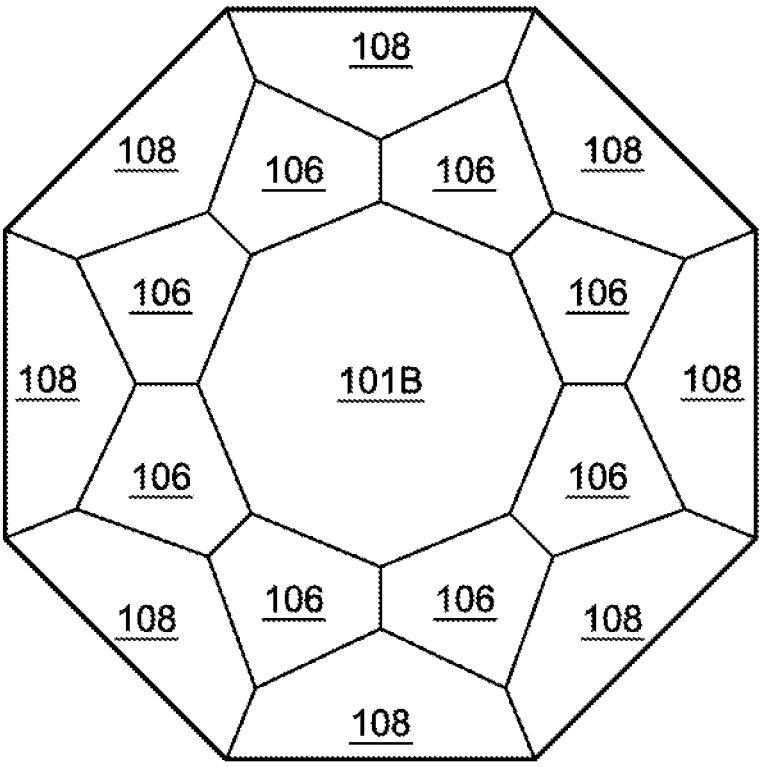
FIG. 5B illustrates a second step of the method of forming the crown of the gemstone of FIG. 1, according to some implementations of the present disclosure.

The next step is shown in FIG. 5B. Here, a second set of crown facets 106 (e.g., a second temporary set of crown facets) is formed on the crown of the gemstone. The second set of crown facets 106 is formed by carving a pentagonal surface out of portions of the first preliminary table 101A and the first set of crown facets 104. The second set of crown facets 106 can be formed at an angle of between about 28° and about 36°, and are generally disposed in a circular pattern about the crown 10 of the gemstone. The gemstone after this step is thus left with a second preliminary table 101B, the second set of crown facets 106, and a third set of crown facets 108. The second preliminary table 101B is formed from the remainder of the first preliminary table 101A, and is generally horizontal. The third set of crown facets 108 (e.g., a third temporary set of crown facets) is formed from the remainder of the first set of crown facets 104, and is formed at the same angle as the first set of crown facets 104. After this step, the crown of the gemstone includes the second preliminary table 101B, the second set of crown facets 106, and the third set of crown facets 108.

Figure 5C:
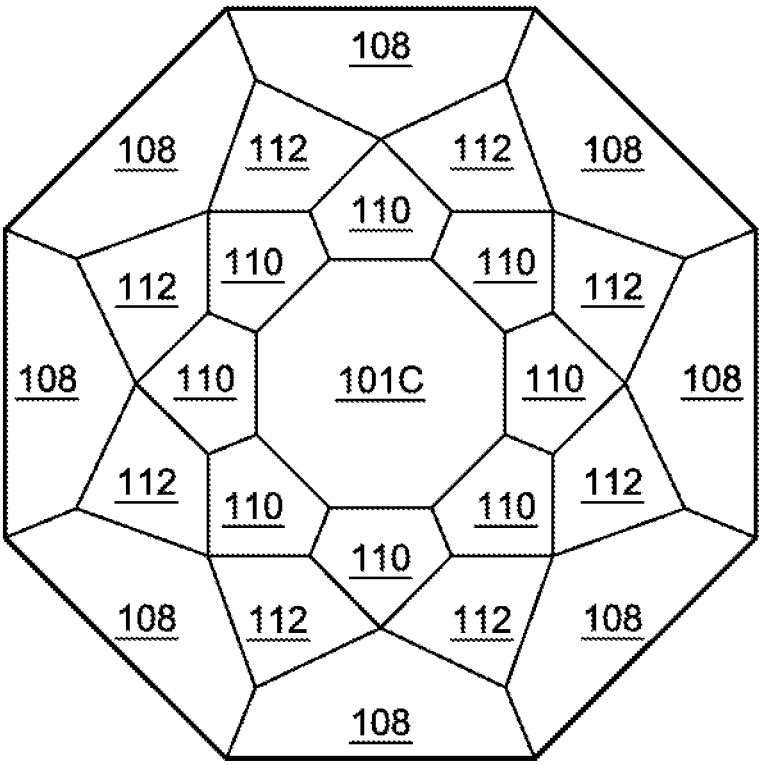
FIG. 5C illustrates a third step of the method of forming the crown of the gemstone of FIG. 1, according to some implementations of the present disclosure.

As shown in FIG. 5C, the next step is to carve out a pentagonal-shaped portions from the second preliminary table 101B and the second set of crown facets 106, to form a fourth set of crown facets 110 (e.g., a fourth temporary set of crown facets). The fourth set of crown facets 110 are formed at an angle of between about 16.5° and about 23°, and are generally disposed in a circular pattern on the crown 10 of the gemstone. The remaining portion of the second preliminary table 101B forms a third preliminary table 101C, which is generally horizontal. The remaining portions of the second set of crown facets 106 form a fifth set of crown facets 112 (e.g., a first final set of crown facets), which are thus disposed at the same angle as the second set of crown facets 106. After this step, the crown of the gemstone includes the third preliminary table 101C, the third set of crown facets 108, the fourth set of crown facets 110, and the fifth set of crown facets 112. The fifth set of crown facets 112 (e.g., the first final set of crown facets) corresponds to the lower intermediate crown facets 18 of the final gemstone.

Figure 5D:
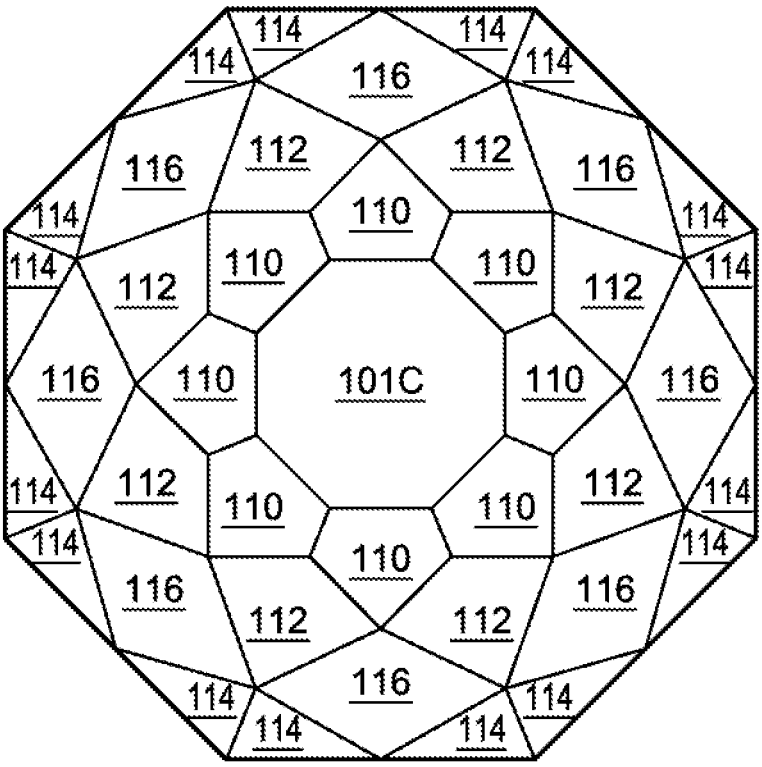
FIG. 5D illustrates a fourth step of the method of forming the crown of the gemstone of FIG. 1, according to some implementations of the present disclosure.

As shown in FIG. 5D, the following step is to carve out a sixth set of crown facets 114 (e.g., a second final set of crown facets) from portions of the third set of crown facets 108. The facets of sixth set of crown facets 114 are triangular-shaped and abut the upper edge of the girdle. The sixth set of crown facets 114 are formed at an angle of between about 52° and about 59°. After the sixth set of crown facets 114 are formed, a seventh set of crown facets 116 (e.g., a third final set of crown facets) is formed from the remainder of the third set of crown facets 108, and is thus formed at the same angle as the third set of crown facets 108 and the first set of crown facets 104.

After this step, the crown of the gemstone includes the third preliminary table 101C, the fourth set of crown facets 110, the fifth set of crown facets 112, the sixth set of crown facets 114, and the seventh set of crown facets 116. The sixth set of crown facets 114 (e.g., the second final set of crown facets) corresponds to the upper girdle facets 22 of the final gemstone. The seventh set of crown facets 116 (e.g., the third final set of crown facets) corresponds to the main crown facets 20 of the final gemstone.

Figure 5E:
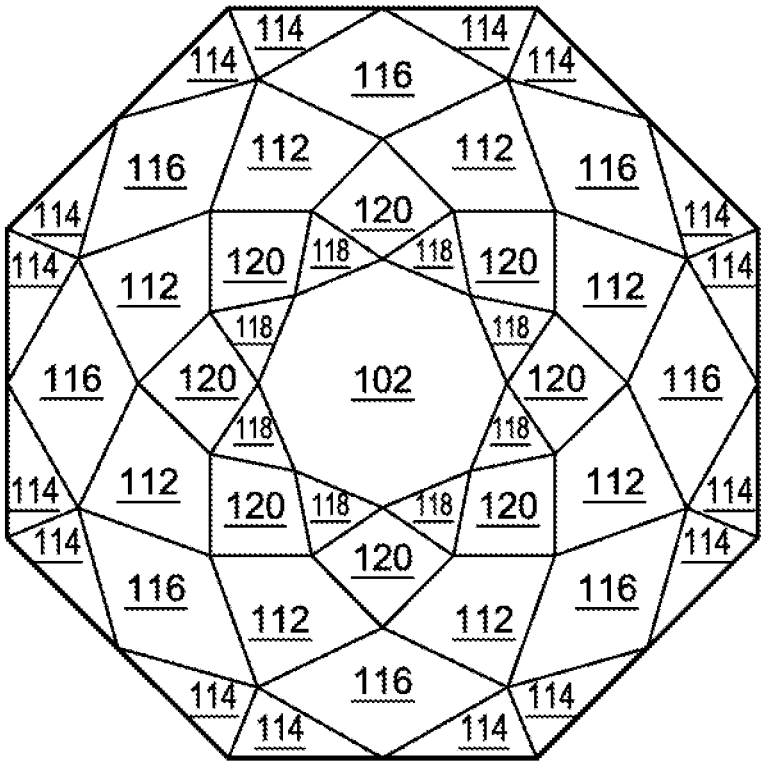
FIG. 5E illustrates a fifth step of the method of forming the crown of the gemstone of FIG. 1, according to some implementations of the present disclosure.

As shown in FIG. 5E, the final step in forming the crown of the gemstone is to carve out an eighth set of crown facets 118 (e.g., a fourth final set of crown facets) from the fourth set of crown facets 110 and the third preliminary table 101C. The eighth set of crown facets 118 are generally triangular-shaped, and are formed at an angle of between about 12° and about 16°. The remaining portions of the fourth set of crown facets 110 form a ninth set of crown facets 120 (e.g., a fifth final set of crown facets), which are thus formed at the same angle as the fourth set of crown facets 110. The remaining portion of the third preliminary table 101C forms a table 102, this is generally horizontal (e.g., disposed at an angle of about) 0°.

As shown in FIG. 5E, the remaining set of facets on the crown (e.g., the first, second, third, fourth, and fifth final sets of crown facets) correspond to the facets on the finished crown in FIGS. 1 and 2. The fifth set of crown facets 112 corresponds to the lower intermediate crown facets 18. The sixth set of crown facets 114 corresponds to the upper girdle facets 22. The seventh set of crown facets 116 corresponds to the main crown facets 20. The eighth set of crown facets 118 corresponds to the star facets 14. The ninth set of crown facets 120 corresponds to the upper intermediate crown facets 16.

Figure 6A:
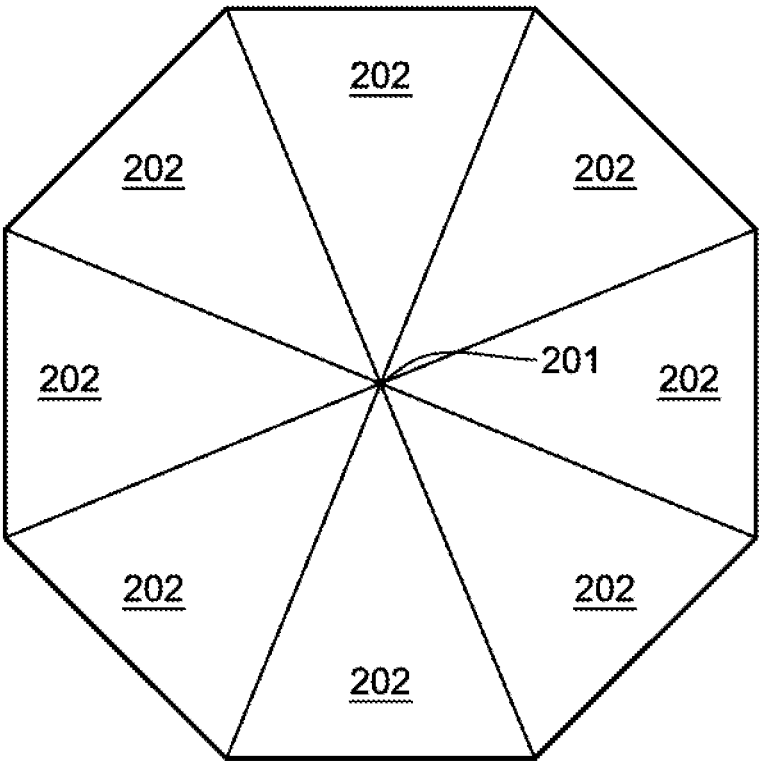
FIG. 6A illustrates a first step of a method of forming a pavilion of the gemstone of FIG. 1, according to some implementations of the present disclosure.

Referring now to FIGS. 6A-6D, the steps for forming the pavilion of the gemstone are illustrated. As shown in FIG. 6A, the first step includes carving a first set of pavilion facets 202 (e.g., a first temporary set of pavilion facets), such that a culet 201 is formed. However, in other implementations, the carving of the first set of pavilion facets 202 may form a lower point. The first set of pavilion facets 202 are formed at an angle of between about 45.5° and about 49°. The angle of the first set of pavilion facets 202 and the angles of subsequent pavilion facets formed in subsequent steps are measured relative to the horizontal plane that is defined by the preliminary tables 101A, 101B, 101C and the table 102 (shown in FIGS. 5A-5E), similar to how the angles of the facets of the completed pavilion were measured in FIG. 1. After this step, the pavilion of the gemstone includes the first set of pavilion facets 202.

Figure 6B:
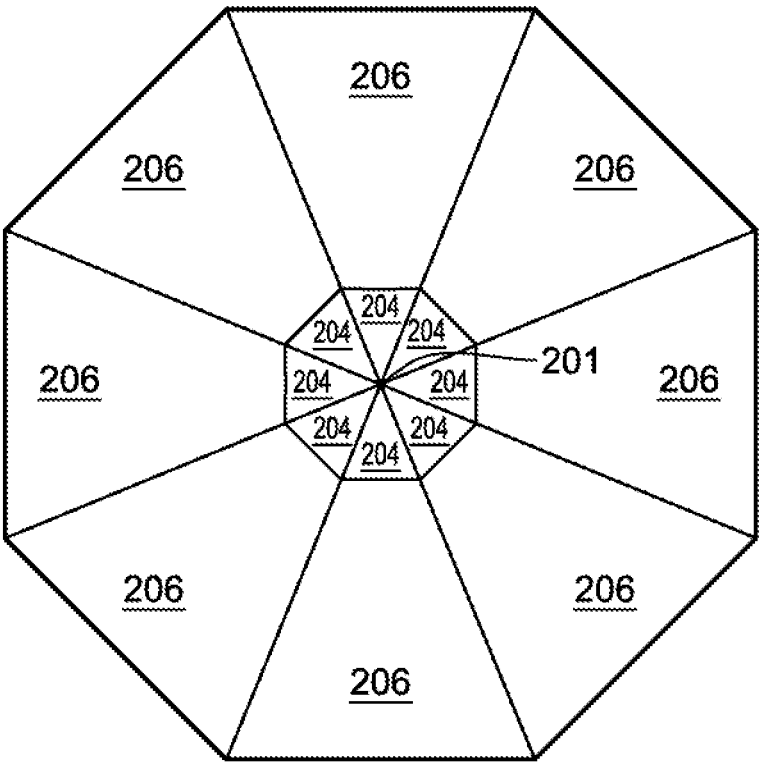
FIG. 6B illustrates a second step of the method of forming the pavilion of the gemstone of FIG. 1, according to some implementations of the present disclosure.

As shown in FIG. 6B, the next step in forming the pavilion is to carve a second set of pavilion facets 204 (e.g., a second temporary set of pavilion facets) from the first set of pavilion facets 202 and the culet 201. The second set of pavilion facets 204 is formed at angle of between about 36° and about 40.5°. The remaining portions of the first set of pavilion facets 202 form a third set of pavilion facets 206 (e.g., a third temporary set of pavilion facets), which are thus generally formed at the same angle as the first set of pavilion facets 202. After this step, the pavilion of the gemstone includes the second set of pavilion facets 204 and the third set of pavilion facets 206.

Figure 6C:
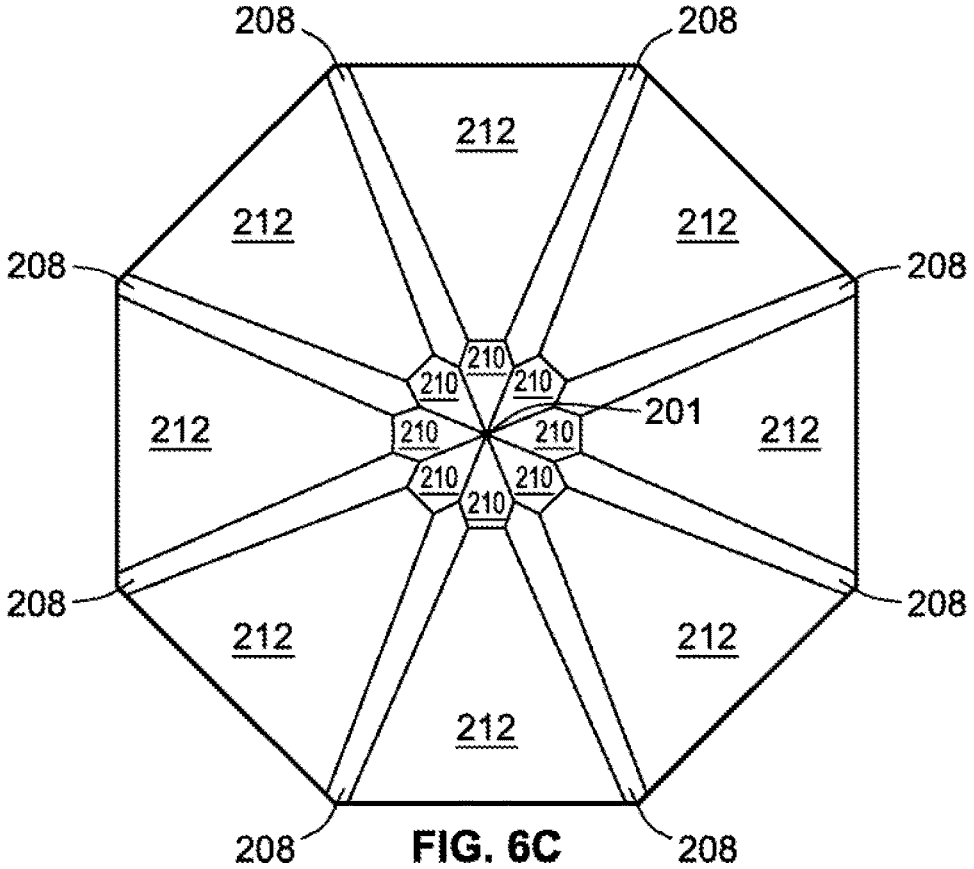
FIG. 6C illustrates a third step of the method of forming the pavilion of the gemstone of FIG. 1, according to some implementations of the present disclosure.

The step is shown in FIG. 6C. Here, a fourth set of pavilion facets 208 (e.g., a fourth temporary set of pavilion facets) are carved into the pavilion from portions of the second set of pavilion facets 204 and the third set of pavilion facets 206. The fourth set of pavilion facets 208 are formed at an angle of between about 42° and about 46.5°. The remainder of the second set of pavilion facets 204 form a fifth set of pavilion facets 210 (e.g., a first final set of pavilion facets), which are thus generally formed at the same angle as the second set of pavilion facets 204. The remainder of the third set of pavilion facets 206 form a sixth set of pavilion facets 212 (e.g., a fifth temporary set of pavilion facets), which are thus generally formed at the same angle as the third set of pavilion facets 206 and the first set of pavilion facets 202. After this step, the pavilion of the gemstone includes the fourth set of pavilion facets 208, the fifth set of pavilion facets 210, and the sixth set of pavilion facets 212. The fifth set of pavilion facets 210 (e.g., the first final set of pavilion facets) corresponds to the culet-adjacent facets 32 of the final gemstone.

Figure 6D:
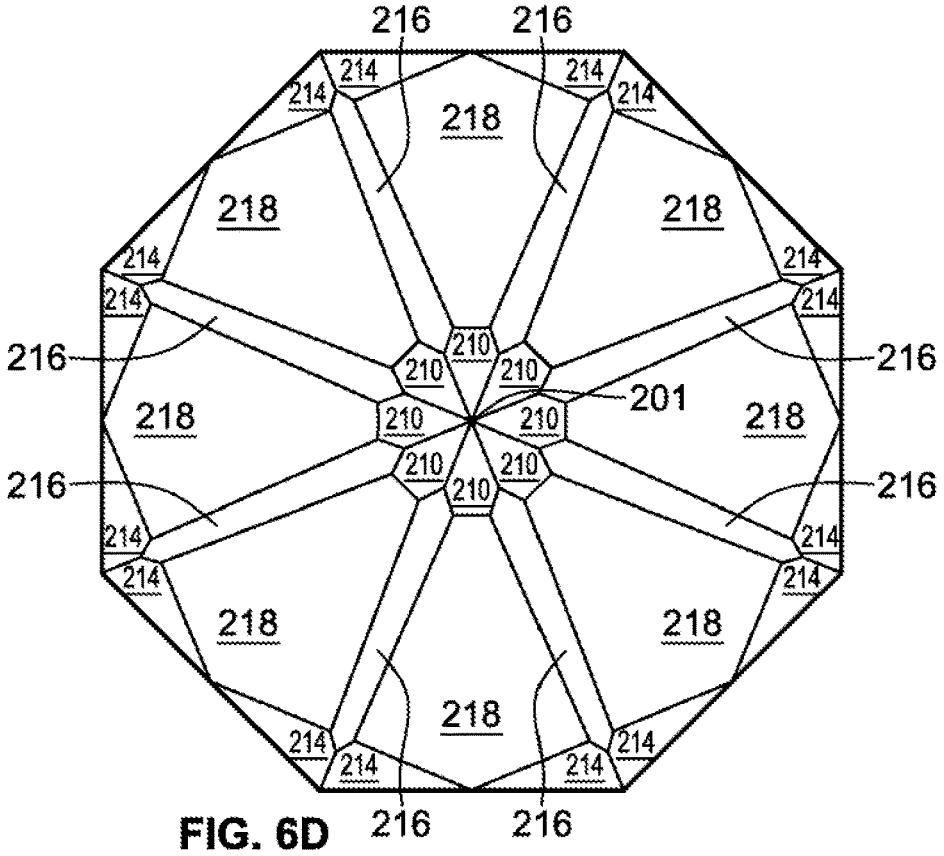
FIG. 6D illustrates a fourth step of the method of forming the pavilion of the gemstone of FIG. 1, according to some implementations of the present disclosure.

As shown in FIG. 6D, the final step in forming the pavilion of the gemstone is to carve a seventh set of pavilion facets 214 (e.g., a second final set of pavilion facets) from portions of the fourth set of pavilion facets 208 and the sixth set of pavilion facets 212. The seventh set of pavilion facets 214 are generally triangular-shaped with a flattened top (e.g., have four edges), and abut the lower edge of the girdle. The seventh set of pavilion facets 214 are formed at an angle of between about 50.5° and about 58°.

The remainder of the fourth set of pavilion facets 208 forms an eighth set of pavilion facets 216 (e.g., a third final set of pavilion facets), which are formed at the same angle as the fourth set of pavilion facets 208. The remainder of the sixth set of pavilion facets 212 form a ninth set of pavilion facets 218 (e.g., a fourth final set of pavilion facets), which are formed at the same angle as the sixth set of pavilion facets 212, the third set of pavilion facets 206, and the first set of pavilion facets 202.

As shown in FIG. 6D, the remaining set of facets on the pavilion (e.g., the first, second, third, and fourth final sets of pavilion facets) correspond to the facets on the finished pavilion in FIGS. 1 and 3. The fifth set of pavilion facets 210 corresponds to the culet-adjacent facets 32. The seventh set of pavilion facets 214 corresponds to the lower girdle facets 38. The eighth set of pavilion facets 216 corresponds to the candle facets 34. The ninth set of pavilion facets 218 corresponds to the main pavilion facets 36.

Thus, a gemstone having a crown, a girdle, and a pavilion are thus formed. The crown and the pavilion comprise a number of sets of interlocking facets that share edges and vertices on the surface of the gemstone. Each of the sets of interlocking facets is disposed at a specific angle. The shape of the facets, the organization of the facets, and the angles that the facets are formed at on the surface of the gemstone result in a gemstone having an improved brilliance. The brilliance refers to the amount of light that enters the gemstone, and is internally reflected such that it exits out of the crown of the gemstone. The facets according to aspects of the present disclosure increase the amount of light reflecting off of the internal surfaces of the facets, thus increasing the brilliance of the gemstone.

One or more elements or aspects or steps, or any portion(s) thereof, from one or more of any of claims 1-20 below can be combined with one or more elements or aspects or steps, or any portion(s) thereof, from one or more of any of the other claims 1-20 or combinations thereof, to form one or more additional implementations and/or claims of the present disclosure.

While the present disclosure has been described with reference to one or more particular implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein, such as, for example, in the alternative implementations described below.

ALTERNATIVE IMPLEMENTATIONS

Alternative Implementation 1. A gemstone comprising: a girdle defining a perimeter of the gemstone, the girdle having an octagon-shaped cross-section; a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including: a plurality of culet-adjacent facets forming a lower point of the pavilion; a plurality of candle facets and a plurality of main pavilion facets, each of the plurality of candle facets being disposed between two of the plurality of main pavilion facets, a lower portion of each of the plurality of candle facets being disposed generally between two of the plurality of culet-adjacent facets, each of the main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween, wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 2. The gemstone of Alternative Implementation 1, wherein the gemstone has a table percentage between about 29% and about 36%.

Alternative Implementation 3. The gemstone of Alternative Implementation 1, wherein the gemstone has a top depth percentage between about 23.5% and about 32%.

Alternative Implementation 4. The gemstone of Alternative Implementation 1, wherein the gemstone has a bottom depth percentage between about 47.5% to about 51.5%.

Alternative Implementation 5. The gemstone of Alternative Implementation 1, wherein the gemstone has a total depth percentage between about 80% and about 89%.

Alternative Implementation 6. The gemstone of Alternative Implementation 1, wherein the gemstone has a girdle thickness percentage between about 3.5% and about 7%.

Alternative Implementation 7. The gemstone of Alternative Implementation 1, wherein a horizontal plane is defined by the table of the gemstone, and wherein each of the plurality of star facets is disposed at a first angle relative to the horizontal plane, each of the plurality of upper intermediate crown facets is disposed at a second angle relative to the horizontal plane, each of the plurality of lower intermediate crown facets is disposed at a third angle relative to the horizontal plane, each of the plurality of main crown facets is disposed at a fourth angle relative to the horizontal plane, and each of the plurality of upper girdle facets is disposed at a fifth angle relative to the horizontal plane.

Alternative Implementation 8. The gemstone of Alternative Implementation 7, wherein first angle is between about 12° and about 16°.

Alternative Implementation 9. The gemstone of Alternative Implementation 7, wherein the second angle is between about 16.5° and about 23°.

Alternative Implementation 10. The gemstone of Alternative Implementation 7, wherein the third angle is between about 28° and about 36°.

Alternative Implementation 11. The gemstone of Alternative Implementation 7, wherein the fourth angle is between about 45.5° and about 49.5°.

Alternative Implementation 12. The gemstone of Alternative Implementation 7, wherein the fifth angle is between about 52° and about 59°.

Alternative Implementation 13. The gemstone of Alternative Implementation 1, wherein a horizontal plane is defined by the table of the gemstone, and wherein each of plurality of culet-adjacent facets is disposed at a first angle relative to the horizontal plane, each of plurality of candle facets is disposed at a second angle relative to the horizontal plane, each of plurality of main pavilion facets is disposed at a third angle relative to the horizontal plane, and each of the plurality of lower girdle facets is disposed at a fourth angle relative to the horizontal plane.

Alternative Implementation 14. The gemstone of Alternative Implementation 15, wherein the first angle is between about 36° and about 40.5°.

Alternative Implementation 15. The gemstone of Alternative Implementation 15, wherein second angle is between about 42° and about 46.5°.

Alternative Implementation 16. The gemstone of Alternative Implementation 15, wherein the third angle is between about 45.5° and about 49°.

Alternative Implementation 17. The gemstone of Alternative Implementation 15, wherein the fourth angle is between about 50.5° and about 58°.

Alternative Implementation 18. A gemstone comprising: a girdle defining a perimeter of the gemstone, the girdle having an octagon-shaped cross-section; and a crown forming an upper portion of the gemstone, a surface of the crown including: a table forming a generally horizontal upper surface of the crown; a plurality of star facets, each of the plurality of star facets being disposed adjacent to and abutting an edge of the table; a plurality of upper intermediate crown facets, each of the plurality of upper intermediate crown facets being disposed generally between two of the plurality of star facets, an upper vertex of each of the plurality of upper intermediate crown facets abutting a vertex of the table; a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets; a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets.

Alternative Implementation 19. A gemstone comprising: a girdle defining a perimeter of the gemstone, the girdle having an octagon-shaped cross-section; and a pavilion forming a lower portion of the gemstone, a surface of the pavilion including: a plurality of culet-adjacent facets forming a lower point of the pavilion; a plurality of candle facets, a lower portion of each of the plurality of candle facets being disposed generally between two of the plurality of culet-adjacent facets; a plurality of main pavilion facets, each of the plurality of main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween.

Alternative Implementation 20. A gemstone comprising: a girdle defining a perimeter of the gemstone, the girdle having an octagon-shaped cross-section; a crown forming an upper portion of the gemstone, a surface of the crown including: a table forming a generally horizontal upper surface of the crown, the table having a generally octagonal shape; a plurality of star facets disposed adjacent to the table, each of the plurality of star facets being triangle-shaped; a plurality of upper intermediate crown facets disposed adjacent to the plurality of star facets, each of the plurality of upper intermediate crown facets being kite-shaped; a plurality of lower intermediate crown facets disposed adjacent to the plurality of upper intermediate crown facets, each of the plurality of lower intermediate crown facets being kite-shaped; a plurality of main crown facets disposed adjacent to the plurality of lower intermediate crown facets, each of the plurality of main crown facets being kite-shaped; and a plurality of upper girdle facets disposed adjacent to the plurality of main crown facets, each of the plurality of upper girdle facets being triangle-shaped; and a pavilion forming a lower portion of the gemstone, a surface of the pavilion including: a plurality of culet-adjacent facets forming a lower point of the pavilion, each of the plurality of culet-adjacent facets having a generally pentagonal shape; a plurality of candle facets and a plurality of main pavilion facets, each of the plurality of candle facets being disposed between two of the plurality of main pavilion facets, each of the plurality of candle facets having six edges, each of the main pavilion facets being disposed between two of the plurality of candle facets and being pentagon-shaped; and a plurality of lower girdle facets formed in pairs of adjacent lower girdle facets, each pair of adjacent lower girdle facets being disposed generally between two of the plurality of main pavilion facets, each lower girdle facet having four edges, wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle.

Alternative Implementation 21. A gemstone comprising: a crown forming an upper portion of the gemstone; a pavilion forming a lower portion of the gemstone; and a girdle positioned between the crown and the pavilion and encircling the gemstone, the girdle having an octagon-shaped cross-section, wherein the gemstone has a top depth percentage between about 23.5% and about 32%, and a bottom depth percentage between about 47.5% and about 51.5%.

Alternative Implementation 22. The gemstone of Alternative Implementation 26, wherein the gemstone has a total depth percentage between about 80% and about 89%.

Alternative Implementation 23. The gemstone of Alternative Implementation 26, wherein the gemstone has a table percentage between about 31% and about 34%.

Alternative Implementation 24. The gemstone of Alternative Implementation 26, wherein the gemstone has a girdle thickness percentage between about 3.5% and about 7%.

Alternative Implementation 25. A gemstone comprising: a crown forming an upper portion of the gemstone; a pavilion forming a lower portion of the gemstone; and a girdle positioned between the crown and the pavilion and encircling the gemstone, the girdle having an octagon-shaped cross-section, wherein the gemstone has a total depth percentage between about 80% and about 89%.

Alternative Implementation 26. A gemstone comprising: a crown forming an upper portion of the gemstone, a surface of the crown being defined by a first plurality of facets, each of the first plurality of facets being disposed at an angle between about 12° and about 59° relative to an upper surface of the gemstone; and a pavilion forming a lower portion of the gemstone, a surface of the pavilion being defined by a second plurality of facets, each of the second plurality of facets being disposed at an angle between about 36° and about 58° relative to the upper surface of the gemstone.

Alternative Implementation 27. A method of forming a crown of a gemstone, comprising: forming a first preliminary table on an upper portion of the gemstone, the first preliminary table being a generally horizontal upper surface; forming a first temporary set of crown facets on the upper portion of the gemstone, the first temporary set of crown facets being formed at an angle of between about 45.5° and about 49.5° relative to the first preliminary table; forming a second temporary set of crown facets on the upper portion of the gemstone from portions of the first preliminary table and the first temporary set of crown facets, the second temporary set of crown facets being formed at an angle of between about 28° and about 36° relative to the generally horizontal upper surface, a remainder of the first preliminary table forming a second preliminary table, a remainder of the first temporary set of crown facets forming a third temporary set of crown facets; forming a fourth temporary set of crown facets on the upper portion of the gemstone from portions of the second preliminary table and the second temporary set of crown facets, the fourth temporary set of crown facets being formed at an angle of between about 16.5° and about 23° relative to the generally horizontal upper surface, a remainder of the second preliminary table forming a third preliminary table, a remainder of the second set of temporary crown facets forming a first final set of crown facets; forming a second final set of crown facets on the upper portion of the gemstone from portions of the third temporary set of crown facets, the second final set of crown facets being formed at an angle of between about 52° and about 59° relative to the generally horizontal upper surface, a remainder of the third temporary set of crown facets forming a third final set of crown facets; and forming a fourth final set of crown facets on the upper portion of the gemstone from portions of the third preliminary table and the fourth temporary set of crown facets, the fourth final set of crown facets being formed at an angle of between about 12° and about 16° relative to the generally horizontal upper surface, a remainder of the third preliminary table forming a final table of the gemstone, a remainder of the fourth temporary set of crown facets forming a fifth final set of crown facets, such that the upper portion of the gemstone is formed from the final table and the first, second, third, fourth, and fifth final set of crown facets.

Alternative Implementation 28. The method of Alternative Implementation 27, further comprising forming a girdle defining a perimeter of the gemstone, the girdle having an octagon-shaped cross-section.

Alternative Implementation 29. A method of forming a pavilion of a gemstone having a horizontal upper surface, comprising: forming a first temporary set of pavilion facets on a lower portion of the gemstone, the first temporary set of pavilion facets being formed at an angle of between about 45.5° and about 49° relative to the horizontal upper surface; forming a second temporary set of pavilion facets on the lower portion of the gemstone from portions of the first temporary set of pavilion facets, the second temporary set of pavilion facets being formed at an angle of between about 36° and about 40.5°, a remainder of the first temporary set of pavilion facets forming a third temporary set of pavilion facets; forming a fourth temporary set of pavilion facets on the lower portion of the gemstone from portions of the second temporary set of pavilion facets and the third temporary set of pavilion facets, the fourth temporary set of pavilion facets being formed at an angle of between about 42° and about 46.5° relative to the horizontal upper surface, a remainder of the second temporary set of pavilion facets forming a first final set of pavilion facets, a remainder of the third temporary set of pavilion facets forming a fifth temporary set of pavilion facets; and forming a second final set of pavilion facets on the lower portion of the gemstone from portions of the fourth temporary set of pavilion facets and the fifth temporary set of pavilion facets, the second final set of pavilion facets being formed at an angle of between about 50.5° and about 58° relative to the horizontal upper surface, a remainder of the fourth temporary set of pavilion facets forming a third final set of pavilion facets, a remainder of the fifth temporary set of pavilion facets forming a fourth final set of pavilion facets, such that the lower portion of the gemstone is formed from the first, second, third, and fourth final set of pavilion facets.

Alternative Implementation 30. The method of Alternative Implementation 29, further comprising forming a girdle defining a perimeter of the gemstone, the girdle having an octagon-shaped cross-section.

What is claimed is:

1. A gemstone comprising:

a girdle defining a perimeter of the gemstone, the girdle having an octagon-shaped cross-section;

a crown forming an upper portion of the gemstone, a surface of the crown including:

a table forming a generally horizontal upper surface of the crown;

a plurality of star facets, each of the plurality of star facets being disposed adjacent to and abutting an edge of the table;

a plurality of upper intermediate crown facets, each of the plurality of upper intermediate crown facets being disposed generally between two of the plurality of star facets, an upper vertex of each of the plurality of upper intermediate crown facets abutting a vertex of the table;

a plurality of lower intermediate crown facets, each of the plurality of lower intermediate crown facets being disposed between two of the plurality of upper intermediate crown facets, an upper vertex of each of the plurality of lower intermediate crown facets abutting a lower vertex of one of the plurality of star facets;

a plurality of main crown facets, each of the plurality of main crown facets being disposed between two of the plurality of lower intermediate crown facets, an upper vertex of each of the plurality of main crown facets abutting a lower vertex of one of the plurality of lower intermediate crown facets; and a plurality of upper girdle facets formed in pairs of adjacent upper girdle facets, each pair of adjacent upper girdle facets being disposed generally between two of the plurality of main crown facets, upper vertices of both upper girdle facets in each pair of upper girdle facets abutting a lower vertex of one of the plurality of lower intermediate crown facets; and a pavilion forming a lower portion of the gemstone, a surface of the pavilion including:

a plurality of culet-adjacent facets forming a lower point of the pavilion;

a plurality of candle facets and a plurality of main pavilion facets, each of the plurality of candle facets being disposed between two of the plurality of main pavilion facets, a lower portion of each of the plurality of candle facets being disposed generally between two of the plurality of culet-adjacent facets, each of the main pavilion facets being disposed between two of the plurality of candle facets, a lower edge of each of the plurality of main pavilion facets abutting an upper edge of one of the plurality of culet-adjacent facets; and a plurality of lower girdle facets formed in pairs of adjacent lower girdle facets, each pair of adjacent lower girdle facets being disposed generally between two of the plurality of main pavilion facets, each pair of adjacent lower girdle facets having an upper portion of a respective one of the plurality of candle facets disposed generally therebetween, wherein the girdle is positioned between the crown and the pavilion, each of the plurality of upper girdle facets being disposed adjacent to and abutting an upper edge of the girdle, and each of the plurality of lower girdle facets being disposed adjacent to and abutting a lower edge of the girdle, and wherein the gemstone has a table percentage between about 31 percent and about 34 percent, and wherein the gemstone has a girdle thickness percentage between about 5 percent and about 7 percent.

2. The gemstone of claim 1, wherein the gemstone has a top depth percentage between about 23.5 percent and about 32 percent.

3. The gemstone of claim 1, wherein the table has a generally octagonal shape, each of the plurality of star facets is triangle-shaped, each of the plurality of upper intermediate crown facets is kite-shaped, each of the plurality of lower intermediate crown facets is kite-shaped, each of the plurality of main crown faces is kite-shaped, and each of the plurality of upper girdle facets is triangle-shaped.

4. The gemstone of claim 1, wherein each of the plurality of upper intermediate crown facets is disposed between two of the star facets and two of the lower intermediate crown facets.

5. The gemstone of claim 1, wherein each of the plurality of lower intermediate crown facets is disposed between two of the upper intermediate crown facets and two of the main crown facets.

6. The gemstone of claim 1, wherein each of the plurality of main crown facets is disposed between two of the lower intermediate crown facets and two of the upper girdle facets.

7. The gemstone of claim 1, wherein each of the facets of the crown is disposed at an angle of between about 12° and about 59° relative to the table of the crown.

8. The gemstone of claim 1, wherein the gemstone has a bottom depth percentage between about 47.5 percent and about 51.5 percent.

9. The gemstone of claim 1, wherein each of the plurality of culet-adjacent facets is pentagon-shaped, each of the plurality of candle facets has six edges, each of the plurality of main pavilion facets is pentagon-shaped, and each of the plurality of lower girdle facet has four edges.

10. The gemstone of claim 1, wherein each of the plurality of candle facets is disposed between two of the plurality of main pavilion facets.

11. The gemstone of claim 1, wherein each pair of adjacent lower girdle facets is disposed between two of the plurality of main pavilion facets and one of the candle facets.

12. The gemstone of claim 1, wherein each of the facets of the pavilion is disposed at an angle between about 36° and about 58° relative to the table of the crown.

13. The gemstone of claim 1, wherein the gemstone has a total depth percentage between about 75 percent and about 95 percent.

14. The gemstone of claim 13, wherein the total depth percentage is between about 80 percent and about 89 percent.

15. The gemstone of claim 1, wherein the table percentage is about 33.5 percent.

16. The gemstone of claim 1, wherein the gemstone has a total depth percentage of about 84.5 percent.

17. The gemstone of claim 1, wherein a combined area of the culet facets is less than an area of the table.

18. The gemstone of claim 1, wherein the gemstone is a precious gemstone or a semi-precious gemstone.

* * * * *